US009964327B2

(12) United States Patent
Masuda et al.

(10) Patent No.: US 9,964,327 B2
(45) Date of Patent: May 8, 2018

(54) AIR-CONDITIONING REMOTE CONTROLLER AND AIR-CONDITIONING SYSTEM

(71) Applicant: Johnson Controls-Hitachi Air Conditioning Technology (Hong Kong) Limited, Kowloon Bay KLN (HK)

(72) Inventors: Ayumi Masuda, Tokyo (JP); Yoshiyuki Yamanashi, Tokyo (JP); Kouichirou Sakurai, Tokyo (JP); Ena Kudo, Tokyo (JP); Satomi Kaito, Tokyo (JP)

(73) Assignee: Johnson Controls-Hitachi Air Conditioning Technology (Hong Kong) Limited, Kowloon Bay KLN (HK)

( * ) Notice: Subject to any disclaimer, the term of this patent is extended or adjusted under 35 U.S.C. 154(b) by 68 days.

(21) Appl. No.: 14/973,276

(22) Filed: Dec. 17, 2015

(65) Prior Publication Data

US 2016/0209073 A1 Jul. 21, 2016

(30) Foreign Application Priority Data

Jan. 15, 2015 (JP) ..... 2015-005607

(51) Int. Cl.
*F24F 11/00* (2018.01)

(52) U.S. Cl.
CPC ..... *F24F 11/0086* (2013.01); *F24F 11/30* (2018.01); *F24F 11/62* (2018.01); *F24F 11/52* (2018.01); *F24F 11/54* (2018.01); *F24F 11/56* (2018.01)

(58) Field of Classification Search
CPC ..... F24F 11/50–11/61; F24F 1/00; F24F 2011/0073
USPC ..... 236/51
See application file for complete search history.

(56) References Cited

U.S. PATENT DOCUMENTS 4,308,527 A * 12/1981 Moreau ..... B60K 37/00 340/286.02
2009/0174682 A1* 7/2009 Bowden ..... B60K 35/00 345/173
2012/0053738 A1* 3/2012 Lingrey ..... F24F 11/0012 700/278

(Continued)

FOREIGN PATENT DOCUMENTS

JP 2007-218574 A 8/2007

*Primary Examiner* — David Teitelbaum
*Assistant Examiner* — Paul Schwarzenberg
(74) *Attorney, Agent, or Firm* — Crowell & Moring LLP

(57) ABSTRACT

An air-conditioning remote controller allowing a user to intuitively grasp a setting status of an air-conditioner and to use the controller commonly between a plurality of models of the main body of the air-conditioners, the air-conditioning remote controller including an input unit to input setting values for setting items relating to air-conditioning control, and a display unit having a predetermined area to display a plurality of icons thereon and displaying setting values and icons depending on the number of taps, wherein the display unit changes the number of displayable icons depending on the number of taps for the main body of the air-conditioner controlled using the setting values, and also displays the icons with the larger size per tap as the number of the icons in the air-conditioner is getting smaller.

16 Claims, 8 Drawing Sheets

FIG.1B

(56) References Cited

U.S. PATENT DOCUMENTS

| | | | | |
|---|---|---|---|---|
| 2012/0092251 | A1* | 4/2012 | Hashimoto | B60K 35/00 345/156 |
| 2013/0158792 | A1* | 6/2013 | Kobayashi | B60K 37/02 701/36 |

* cited by examiner

AIR-CONDITIONING REMOTE CONTROLLER AND AIR-CONDITIONING SYSTEM

CROSS-REFERENCE TO RELATED APPLICATIONS

The present application relates to and claims priority from Japanese patent application No. 2015-005607, filed on Jan. 15, 2015. The entirety of the contents and subject matter of all of the above is incorporated herein by reference.

BACKGROUND OF THE INVENTION (1) Field of the Invention

The present invention relates to an air-conditioning system, in particular an air-conditioning controlling terminal (hereinafter, referred to air-conditioning remote controller).

(2) Related Art

An air-conditioner air-conditions a room by circulating indoor air into a heat exchanger, conditioning the air by heating, cooling, and dehumidification, and blowing the conditioned air from the air-conditioner into the room. At this time, a user of the air-conditioner uses a remote controller in order to set comfortable air direction, airflow rate, and the like.

The remote controller typically includes a display unit indicating various setting statuses, and an operating unit. The operating unit is provided with buttons such as an operation start and stop button, a temperature setting button, an airflow direction setting button, an airflow rate setting button, an operation mode switching button. The user presses a button such as the airflow direction and the airflow rate setting button, and thereby sets preferable conditions such as airflow direction and airflow rate (for example, refer to Japanese Patent Document JP-2007-218574 A1 (particularly see FIGS. 12 and 13)).

SUMMARY OF THE INVENTION

Problems to be Solved

The above patent literature describes an art that the airflow-rate display area of the display unit has five bars and also has under-bars below the five bars. The five bars are arranged such that their heights increase stepwise from the left (soft airflow) to the right (strong airflow) and are displayed or non-displayed according to the airflow rate, and the under-bars are displayed for 24 hours.

Those under-bars represent a maximum settable value for the airflow rate. The maximum settable value (the number of taps), however, is expected to vary depending on the model of a main body of the air-conditioner, and other settings, for example, airflow direction, is similarly expected to have its settable number of taps depending on the model. Therefore, there is a problem that the user cannot use a remote controller common for multiple models, which displays an icon such as a bar for the setting value relating to air-conditioning control.

Moreover, there is a problem that the 24-hour displayed under-bar occupies extra space and is uneasy for the user to read due to its small display size even in a case that there is no room in a display area.

Also, if an indoor unit is installed on a ceiling or wall, the airflow is directed from upward to downward. Therefore, there is a problem that the display of the airflow rate increasing from left to right causes the user to feel divergence between the display and the actual feeling when regulating the airflow rate.

An object of the present invention is to solve the above problems and to provide an air-conditioning remote controller and air-conditioning system that enable the user to intuitively grasp the settings of the air-conditioner, and is able to be commonly used for more than two models of the main body of the air-conditioner.

Means for Solving the Problems

To achieve the above object, the air-conditioning remote controller of the present invention is provided with an input unit to enter values for setting items relating to the air-conditioning control and a display unit that has a predetermined area for displaying a plurality of icons (e.g., area 520 in FIG. 1B) to display the icons according to the setting values and the settable number of taps for the setting items, wherein the display unit changes the number of displayable icons depending on the number of taps for the main body of the air-conditioner to be controlled using the setting values. Additionally, the display unit displays a larger icon area per tap as the displayable number of the icons for the main body of the air-conditioner decreases. Other aspects of this invention are explained in embodiments described below.

Effect of the Invention

The present invention provides an air-conditioning remote controller and an air-conditioning system that allows the user to intuitively grasp the setting status of the main body of the air-conditioner and enables the plurality of models of air-conditioners to share the same controller.

BRIEF DESCRIPTION OF SEVERAL VIEWS OF THE DRAWINGS

FIG. 1A is a diagram showing an overall view of the air-conditioning remote controller, and FIG. 1B is a diagram showing a display content of an airflow rate regulation display-field.

FIG. 4A is a diagram showing a case in which a temperature setting display field is selected; FIG. 4B is a diagram showing a case in which the airflow rate control display field is selected and the airflow rate is a soft airflow; and FIG. 4C is a diagram showing the airflow rate control display field in a case in which the airflow rate is changed from the airflow rate in FIG. 4B (soft airflow) to a strong airflow.

FIG. 5A is a diagram showing a case in which the number of airflow taps is three; FIG. 5B is a diagram showing a case in which the number of airflow taps is four; and FIG. 5C is a diagram showing a case in which the number of airflow taps is six.

FIG. 6A is a diagram showing a case in which the maximum number of displayable taps is fixed to six and the number of the airflow rate taps of an air-conditioner is three; FIG. 6B is a diagram showing a case in which the maximum number of displayable taps is fixed to six and the airflow rate taps of an air-conditioner is six;

DETAILED DESCRIPTION OF THE INVENTION

An embodiment for carrying out the present invention is described in detail with reference to the drawings appropriately as needed.

Figure 1A:
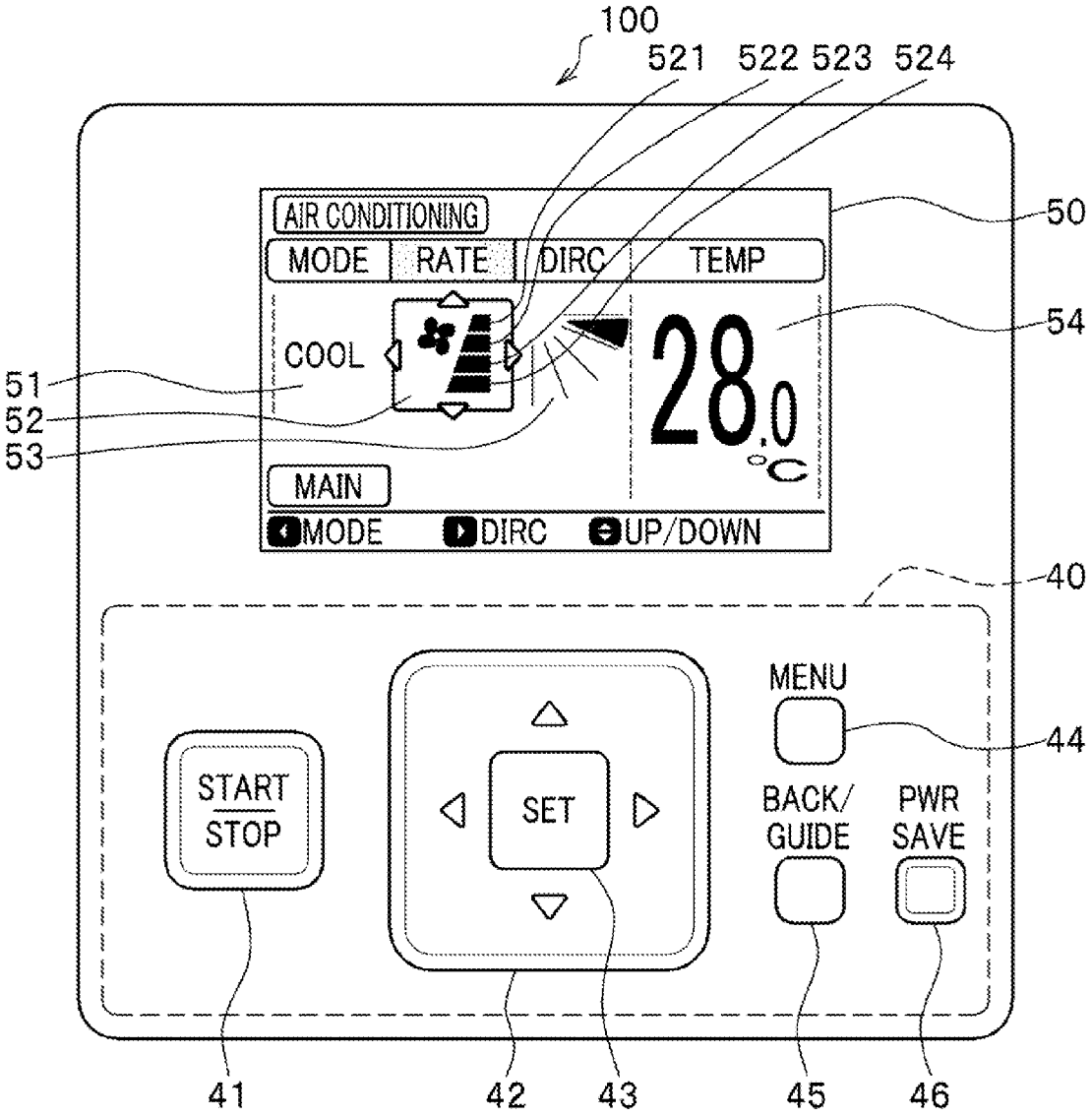
FIGS. 1A and 1B are diagrams showing a structure and exemplary screen of an air-conditioning remote controller according to an embodiment of the present invention.
Figure 1B:
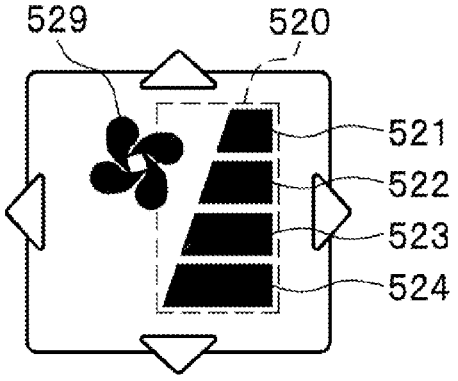

FIGS. 1A and 1B are diagrams showing a configuration and exemplary screen of an air-conditioning remote controller 100 according to the embodiment of the present invention. FIG. 1A shows an overall view of the air-conditioning remote controller and FIG. 1B shows a display example of an airflow rate regulation display-field. The air-conditioning remote controller 100 shown in FIG. 1A includes an input unit 40 and a display unit 50. The input unit 40 includes an operation start/stop switch 41, a cross switch 42 to be operated to select an item and to change settings for the item selected, a decision switch 43 to decide the setting, a menu switch 44, a back/guide switch 45 for returning back to an operation/control screen as well as displaying a guide menu, and a power saving switch 46 for switching the operation to a power-saving setting. Additionally, the operation start/stop switch 41 is attached with a light emitting means (for example, light emitting diode (LED)), which is controlled to, for example, light up green during operation, light off during operation-stop, and light up red if a trouble occurs in the air-conditioner.

The display unit 50 includes display fields to display current settings in sub-fields partitioned for every setting item, such as an operation mode display field 51 displaying an operation mode including a cooling mode, a heating mode, an automatic cooling and heating mode, and an air blowing mode; an airflow-rate regulation display field 52; an airflow direction display field 53; the temperature setting display field 54.

The airflow-rate regulation display field 52 of the present embodiment has a predefined area (airflow-rate icon area) 520 for displaying an icon for the airflow rate in the top-to-bottom direction (vertically) divided by the number of airflow rate taps, and each of the divided areas has a trapezoid whose pair of opposite sides in the top-to-bottom direction are mutually parallel and whose size is larger in the direction from the upper to the lower to display the setting information on the airflow rate. For example, FIG. 1B shows a case in which the number of the airflow rate taps is four and the trapezoidal icons are arranged being numbered as 521, 522, 523, and 524 in the direction from the upper toward the lower. The trapezoidal portions 521, 522, 523, and 524 correspond to soft, weak, strong, and rapid airflow. a windmill icon 529 is also displayed as a symbol for a fan indicating an airflow rate.

Trapezoidal portions 521, 522, 523, and 524 are becoming larger in the direction from the upper to the lower (e.g., their lengths in the horizontal directions become longer in the vertical directions), and thereby made easy for a user to intuitively grasp and to view an image of the airflow rate getting larger. Incidentally, the horizontally long upper side of the trapezoidal portion 521 is an image of a horizontally long air outlet of the indoor unit 202 (see FIG. 2).

Additionally, regulating the airflow rate is performed by pressing the top switch or the bottom switch of the cross switch 42, thereby the airflow rate is changed and the changed status is displayed in the airflow-rate regulation display field 52 in which the trapezoidal portions 521, 522, 523, and 524 are displayed or non-displayed. Therefore, the vertical movement of the user pressing the switch is equal in the top-to-bottom direction of the display and non-display of the trapezoidal portions 521, 522, 523, and 524, which gives the present embodiment an advantageous feature that an operation and a check of the operation result are easy for the user to check.

Comparing the present invention with, for example, the above patent document 1, the patent document 1 describes a remote controller increasing the number of bars showing the airflow rate from left to right each time of pressing the airflow rate button. Therefore, this embodiment of the present invention solves a problem that the remote controller described by the above patent document gives a user intuitive strangeness such that the airflow rate display varying in the direction from the left to the right when performing an airflow rate regulation makes the user feel as the airflow rate is different in the right and left direction.

Figure 2:
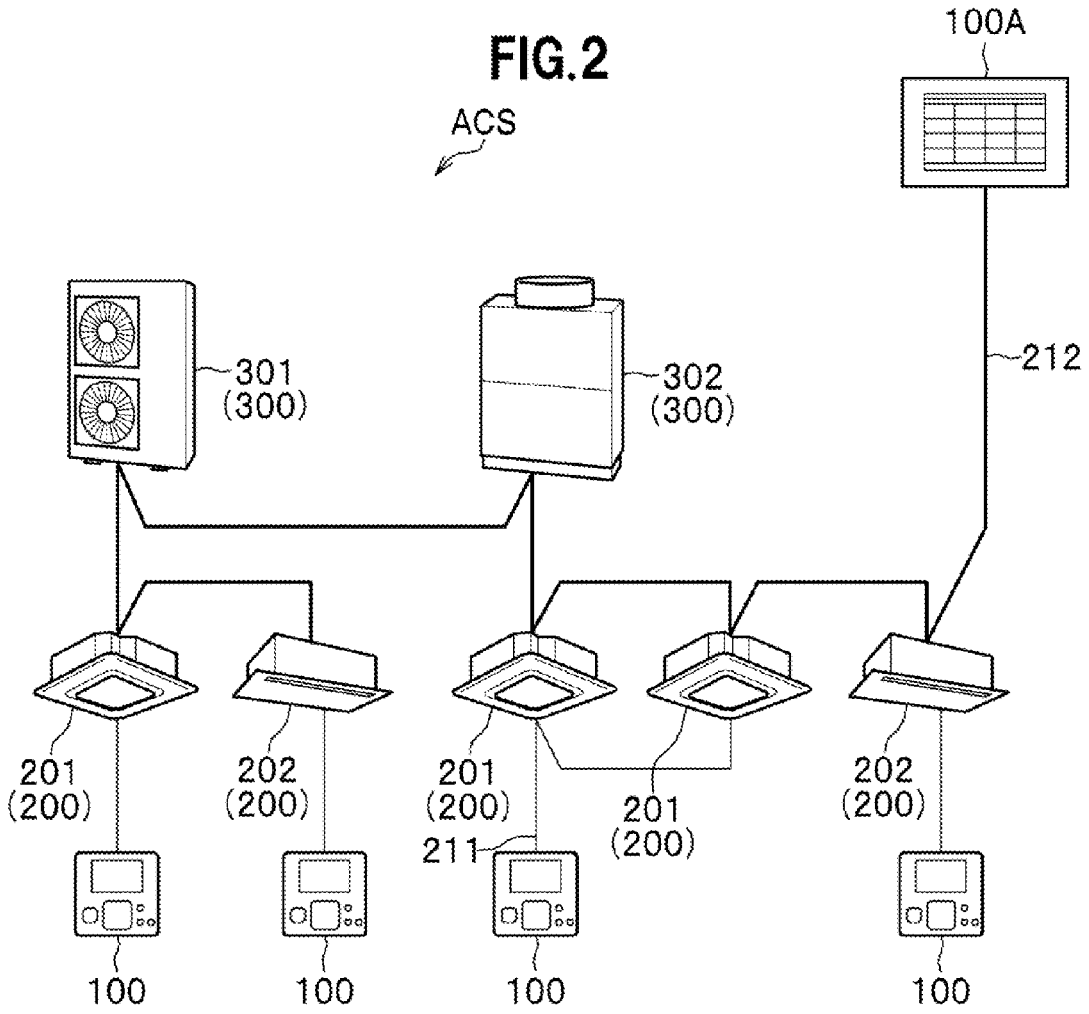
FIG. 2 is a diagram showing an overall structure of an air-conditioning system.

Furthermore, the number of the airflow rate taps is determined for each model of the main bodies of air-conditioners (in the case of FIG. 2, indoor units). The air-conditioner regulates stepwise the airflow rate driven by an airflow blowing fan by tap control. That is, the air-conditioner is provided with a plurality of taps for switching a voltage applied to a fan motor driving the airflow blowing fan between multiple steps of voltages, and selective switching of taps allows stepwise setting to an airflow rate uniquely determined depending on the selected tap.

The display unit 50 is configured, as the details described below, to change the number of trapezoidal icons to be displayed depending on the number of the main body of the airflow rate taps of the air-conditioner communicating with the air-conditioning remote controller 100. Similarly, for the number of the airflow direction taps, the number of settable angles varies depending on the model of the main body of the air-conditioner, and therefore, the display unit 50 is able to change the number of icons representing the settings for the airflow direction to be displayed according to the model.

FIG. 2 shows the overall structure of an air-conditioning system ACS. The air conditioning system ACS includes the air-conditioning remote controller 100, the indoor unit 200, an outdoor unit 300, a central control device 100A, and the like. The indoor unit 200 includes an indoor unit 201 that is able to direct the airflow to four directions and an indoor unit 202 that is able to direct the airflow into two directions, and the indoor units are arranged appropriately as necessary. The outdoor unit 300 includes outdoor units 301 and 302 having different air-conditioning capability from each other. The indoor unit 200 is connected with the air-conditioning remote controller 100 via a communication channel 211 (control line). In addition, the central control device 100A is also connected with the indoor units 200 and the outdoor units 300 via a communication channel 212 (control line).

Figure 3:
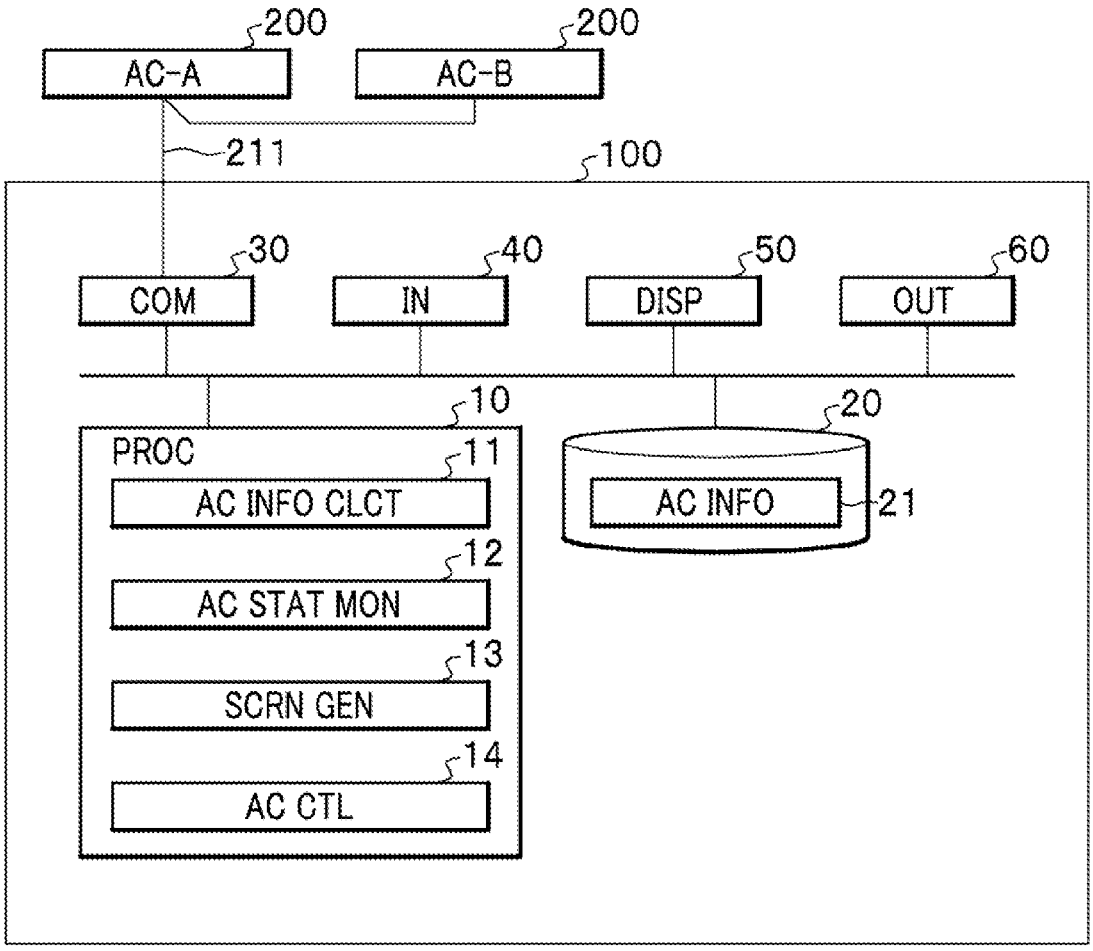
FIG. 3 is a diagram showing a control block of the air-conditioning remote controller.

FIG. 3 is a diagram showing a control block of the air-conditioning remote controller 100, which is configured to include a processing unit (PROC) 10 to perform various processes to monitor and control the air-conditioner, a storage unit 20 to store the air-conditioner information (AC INFO) 21, a communication unit (COM) 30 to communicate with the air-conditioner that is connected with each other via the communication channel 211, the input unit (IN) 40 to input a user operation, the display unit (DISP) 50 to display an output screen, and an output unit (OUT) 60 to output a lighting signal to a lighting means of the operation start/stop switch 41 (see FIG. 1).

The processing unit 10 is implemented with a central processing unit (CPU) that runs according to a program and controls the screen display of the display unit 50. Examples of the storage unit 20 are a flash memory, a hard disk, and the like. Examples of the input unit 40 are a button, a touch panel, and the like. Examples of the display unit 50 are a display and the like. Examples of the output unit 60 are a speaker, an LED, and the like. Examples of a communication channel 211 are two core lines, three core lines, and the like. The communication channel 211 may be wireless.

The air-conditioner information 21 includes, for example, operation stop information, operation mode information (cooling, heating, drying, blowing, etc.), temperature setting information, indoor temperature information, airflow rate information, airflow direction information, information on power consumption, consumed power information, output information, error information, the number of airflow rate taps, and the like.

The processing unit 10 is configured to include an air-conditioner information collecting unit 11 collecting the air-conditioner information 21 of an air-conditioner A (AC-A; in FIG. 2, indoor unit 201) and an air-conditioner B (AC-B; in FIG. 2, indoor unit 202) to store the air-conditioner information 21 in the storage unit 20; an air-conditioner status monitoring unit 12 monitoring the status of the air-conditioners on the basis of the air-conditioner information 21 stored; a screen generation unit 13 generating a screen to be presented to a user using the air-conditioner information 21 stored, an air-conditioner controlling unit 14 controlling the air-conditioners according to a user's operation inputted through the input unit 40. Note that FIG. 3 shows only one example of the air-conditioning remote controller 100, and is not intended to limit the configuration, the number, the connection form, and the like of the air-conditioners.

The air-conditioning remote controller 100 of this embodiment is provided with a display unit 50 displaying icons according to the setting values and the number of taps for the setting items. The display unit 50 is able to change the number of displayable icons depending on the number of taps for the main body of the air-conditioner controlled using the settings. Additionally the display unit 50 is able to display the larger icon area per tap as the fewer displayable icons are assigned to the main body of the air-conditioner. The detail is described below referring to FIG. 5.

Figure 4A:
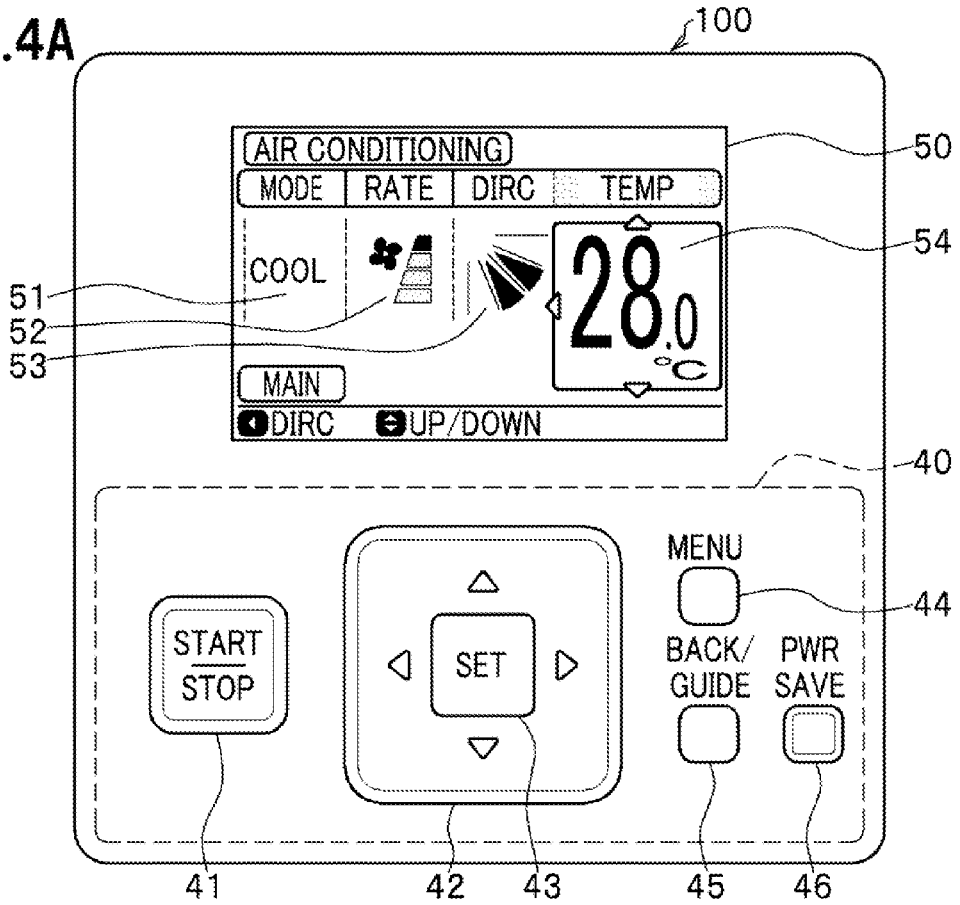
FIGS. 4A, 4B, and 4C are diagrams showing how to set the airflow rate of the air-conditioning remote controller.
Figure 4B:
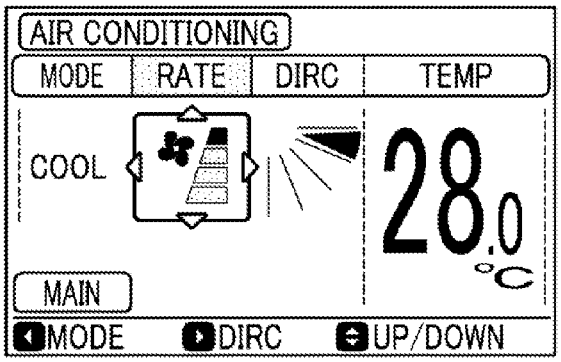
Figure 4C:
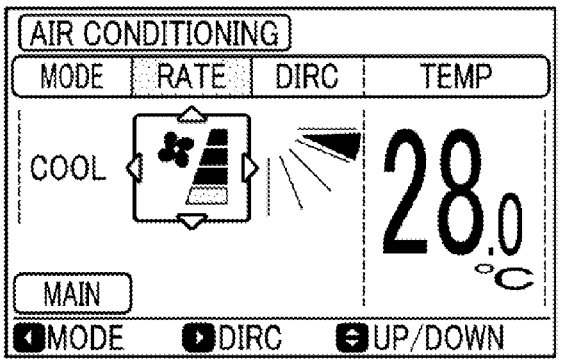

FIGS. 4A to 4C are diagrams illustrating how to set the airflow rate of the air-conditioning remote controller 100. FIG. 4A shows a case in which the temperature setting display field is selected; FIG. 4B shows a case in which the airflow rate control display field is selected (the airflow rate is the soft airflow); and FIG. 4C shows a case in which the airflow rate is changed from the soft to the strong airflow. Referring to FIGS. 4A to 4C, a description is given of a procedure for the user to switch the temperature setting display field 54 to the airflow-rate regulation display field 52 to change the airflow rate from the soft to the strong airflow.

First, when the user, at a screen of a cursor display status shown in FIG. 4A, presses twice a left switch of the cross switch 42, the screen is changed to a cursor display status in which the airflow-rate regulation display field 52 is selected as shown in FIG. 4B. Then, when the user presses twice the bottom switch of the cross switch 42 to change the airflow rate, the user is able to change the airflow rate from the soft to the strong airflow status shown in FIG. 4C.

Figure 5A:
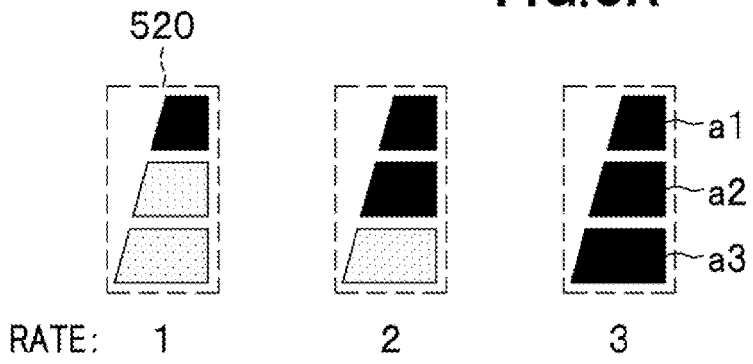
FIGS. 5A, 5B, and 5C are diagrams showing how to display the airflow rate control display fields with various numbers of airflow rate taps.
Figure 5B:
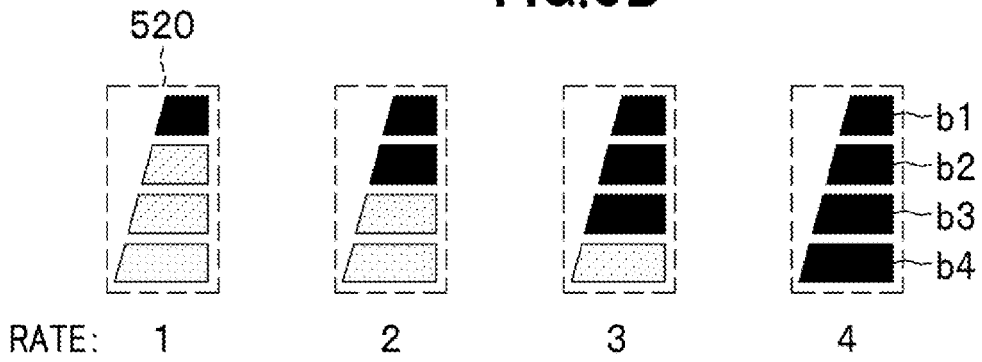
Figure 5C:
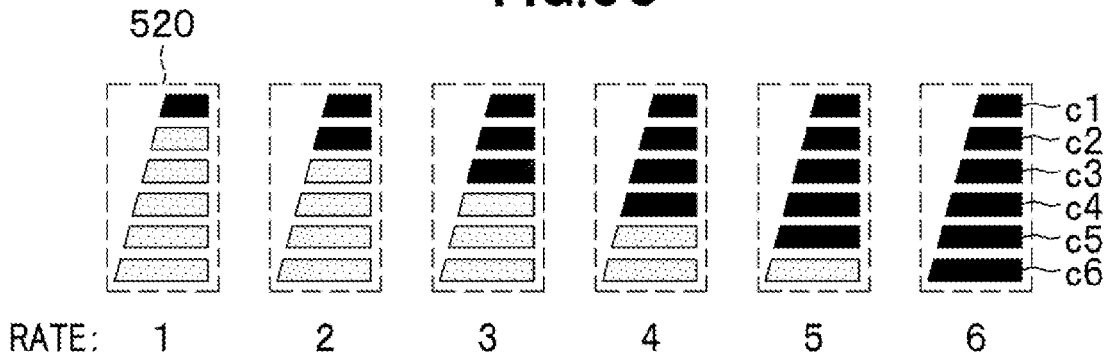

FIGS. 5A to 5C show an example of changing the display in the area 520 according to the model of the main body of the air-conditioner controlled using the settings of the input unit 40. That is, FIGS. 5A to 5C are diagrams showing a method to display the area 520 for the various number of the airflow rate taps: FIG. 5A shows a case in which the number of airflow taps is three; FIG. 5B shows a case in which the number of airflow taps is four; and FIG. 5C shows a case in which the number of airflow taps is six. Referring to FIGS. 5A to 5C, a description is given of a capability to change the display manner in the area 520 if the numbers of the airflow taps for each type of air-conditioners (indoor units) are different from each other. Here, the explanation is made, associating a setting stage of the airflow rate with a numeral. It is assumed that a numeral "1" indicates the smallest airflow rate, and that the airflow rate increases as the number is getting larger.

In the case shown by FIG. 5A, i.e., the case in which the number of the airflow taps is three, when the airflow rate setting (hereinafter, simply referred to as "airflow rate") is "1", the uppermost trapezoidal portion a1 is displayed in black (a second color) and the other trapezoidal portions a2 and a3 are displayed in a first color different from the second color (in the figure, displayed in fine dots); when the airflow rate is "2", the two trapezoidal portions a1 and a2 are displayed in black; when the airflow rate is "3", which corresponds to the maximum airflow rate, the three trapezoidal portions a1, a2, and a3 are displayed in black.

In the case shown by FIG. 5B, i.e., the case in which the number of the airflow taps is four, as the airflow rate is changed in a sequence from "1" to "4", the trapezoidal portions: b1, b2, b3, and b4 are increasingly displayed in black in the sequence. Similarly, in the case shown by FIG. 5C, i.e., the case in which the number of the airflow taps is six, as the airflow rate is changed in a sequence from "1" to "6", the trapezoidal portions: c1, c2, c3, c4, c5, and c6 are increasingly displayed in black in the sequence.

In the case shown by FIGS. 5A to 5C, the screen generation unit 13 (see FIG. 3), even if the number of the airflow rate taps is changed, may keep the same size of the area 520 for each case, to change the number of the trapezoidal portions based on the number of the airflow taps, and to display the necessary number of the trapezoidal portions. That is, the screen generation unit 13 divides the area 520 into sub-areas in the top-to-bottom direction (vertical direction) by the number of the airflow taps, and displays the airflow rate setting information using such the trapezoids that are getting larger as going from top to bottom within each of the sub-areas, which trapezoids have a pair of opposite sides in the top-to-bottom direction that are mutually parallel.

Thus, the present embodiment enables multiple models of the main bodies of the air conditioners to use the common air-conditioning remote controller that display icons by changing the number of taps and the number of displayable icons (trapezoidal portions) for indicating the setting values for the setting items relating to the air-conditioning control according to the number of settable taps for each of the main bodies of the air-conditioners. Further, changing the icon size per tap depending on the number of taps enables the setting status to be displayed while increasing the visibility in a limited area 520. That is, the display unit 50 increases the icon size per tap as the number of taps is getting smaller, thereby enables the visibility to be improved.

The screen generation unit 13, when displaying a trapezoid on the display unit 50, may display the trapezoid for the number of the airflow rate taps in a first color, and the airflow rate settings in a second color different from the first color. For example, the example shown in FIG. 5A to 5C uses gray for the first color, and black for the second color. Gray may have different brightnesses depending on difference in a mixing ratio of the black and white. Lowering the brightness of the tap that is settable but unset than that of the tap that is already set enables the setting status to be easily grasped and easily viewed by a user.

The screen generation unit 13 displays each of a plurality of trapezoids displayed on the display unit 50 such that at least one side of the each pair of opposite sides in the left-to-right direction aligns to form a straight line, and thereby, even if the area 520 is smaller, the image of the airflow rate is able to be clearly displayed to the user.

Note that the area 520 has a size with, for example, the top-to-bottom (vertical) length of approximately 10 mm and the left-to-right (horizontal) length of approximately 5 mm, and thus the key factor is how to express the magnitude of the airflow rate using a picture image.

Figure 6A:
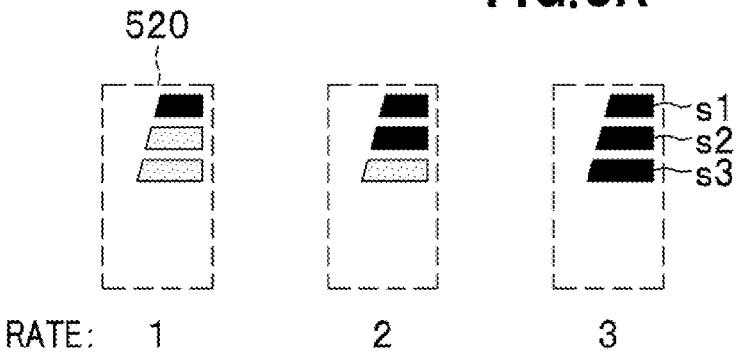
FIGS. 6A and 6B are diagrams showing how to an alternative way to display the number of the airflow rate taps.
Figure 6B:
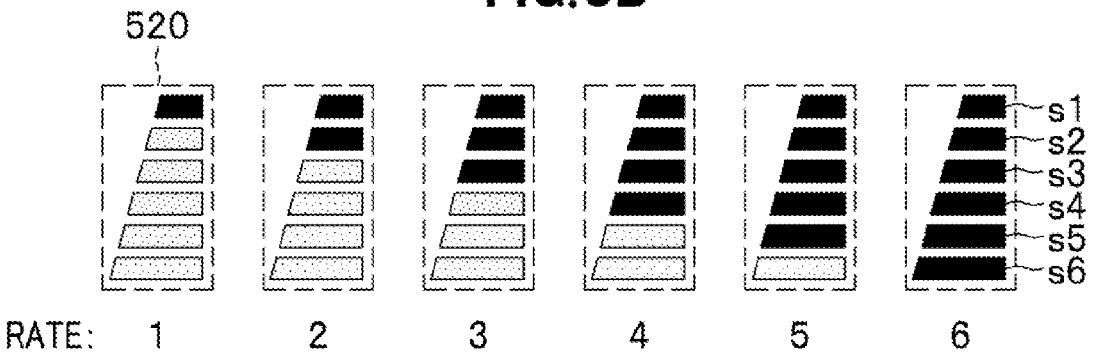

FIGS. 6A and 6B are diagrams showing an alternative way of displaying cases of the different numbers of the airflow rate taps. FIG. 6A shows a case in which the number of displayable airflow rate taps is fixed to six and the number of settable airflow rate taps is three, FIG. 6B shows a case in which the number of displayable airflow rate taps is also fixed to six and the number of settable airflow rate taps is six. FIGS. 6A and 6B show cases of using a six-segment display in the area 520 of the display unit 50. If the number of the displayable airflow rate taps is predetermined as six, the six-segment display is provided in the area 520 of the display unit 50. The six-segment display includes segments s1, s2, s3, s4, s5, and s6. The number of displayable icons (the number of segments) may be set to be equal to or higher than the maximum number of the taps (upper limit value) of each model of the air-conditioners that can be used, so as to deal with up to the model with the maximum number of taps. Each segment has a trapezoidal shape.

In the case of FIG. 6A, i.e., the case that the number of the airflow rate taps is three: when the airflow rate is one, the segment s1 is displayed with black light (corresponding to the second color), the other segments s2 and s3 are displayed in gray light (corresponding to the first color; fine dots in the figure); when the airflow rate is two, two segments s1 and s2 are displayed with black light; when the airflow rate is three, corresponding to the maximum airflow rate, three segments s1, s2, and s3 are displayed with black light.

In the case of FIG. 6B, i.e., the case that the number of the airflow rate taps is six, when the airflow rate is one, the segment s1 is displayed with black light (corresponding to the second color), the other segments s2 to s6 are displayed in gray light (corresponding to the first color, fine dots in the figure); when the airflow rate is two, the two segments s1 and s2 are displayed with black light; when the airflow rate is three, the three segments s1, s2, and s3 are displayed with black light; when the airflow rate is four, the four segments s1, s2, s3, and s4 are displayed with black light; when the airflow rate is five, the five segments s1, s2, s3, s4, and s5 are displayed with black light; when the airflow rate is six, corresponding to the maximum airflow rate, all the six segments s1, s2, s3, s4, s5, and s6 are displayed with black light. Every case shown in FIG. 6A displays no segments of s4 to s6, which corresponds to the number of taps greater than the number of settable taps, and thus, prevents a user from misreading the upper limit of settings.

Alternatively, the airflow rate in the case that the number of the airflow rate taps is three may be displayed using six segments as: when the airflow rate is one, the segments S1 and S2 may be displayed with black light; when the airflow rate is two, the segments S3 and S4 may be displayed with black light; when the airflow rate is three, the segments S5 and S6 may be displayed with black light. In other words, the two segments correspond to one airflow rate. This allows the user to simply and intuitively grasp the setting status of the airflow rate of the air-conditioner.

FIGS. 6A and 6B show the case using the six-segment display, but the present embodiment is not limited thereto. For example, a liquid crystal display that can display in dot pitch may display the similar picture. That is, the processing unit 10 of the air-conditioning remote controller 100 of the present embodiment, when displaying the setting information of the airflow rate inputted through the input unit 40 on the display unit 50, divides a predefined area (for example, the area 520) in the top-to-bottom direction by the number of the displayable airflow rate taps (for example, "six", fixed as the number of displayable airflow rate taps), and displays the setting information on the airflow rate by displaying in each of the divided areas a trapezoid whose pair of opposite sides in the top-to-bottom direction are mutually parallel so that the size of each trapezoid is getting larger as going from the top to the bottom.

In addition, FIGS. 5A to 5C and FIGS. 6A to 6B show display methods for the airflow rate, and the display methods may also be applied to the display of the settings for other operating items such as airflow direction. That is, for a model that can change an angle of the airflow in three stages (a case of three airflow direction taps), the display unit 50 may allow three icons to be displayed, and for a model that can change an angle of the airflow in five stages (a case of five airflow direction taps) may allow five icons to be displayed.

Figure 7:
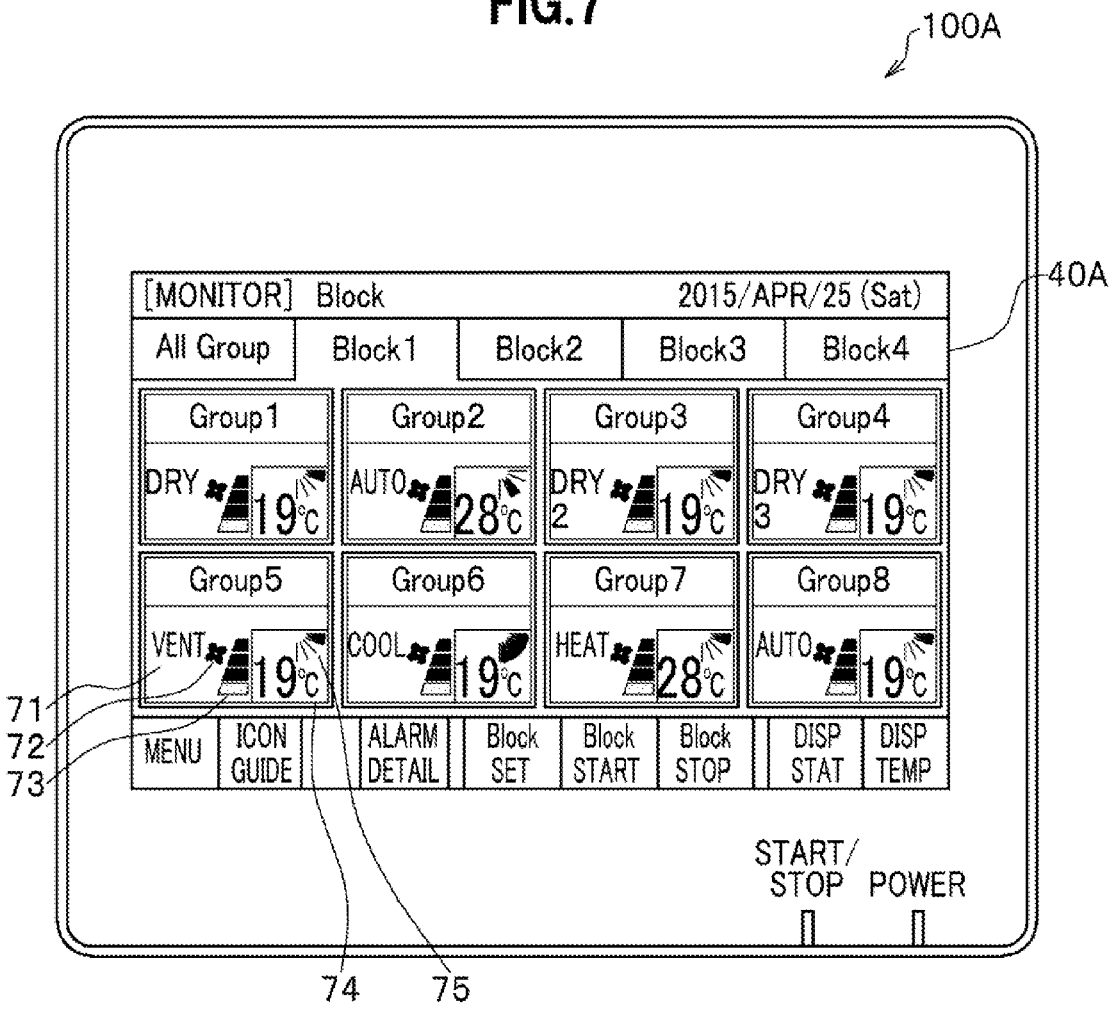
FIG. 7 is a diagram showing a screen example of a central control device.

FIG. 7 is a diagram showing an exemplary screen of the central control device 100A. Referring to FIG. 7, a description is given of a case in which the display method of the airflow rate settings for the area 520 (see FIG. 1) is applied on the display unit 40A of the central control device 100A. The central control device 100A may manage the air-conditioning statuses of hundreds indoor units. FIG. 7 shows an example in which the entire groups may be divided into blocks to be managed per block, and each block may be regulated per group. For example, the group is a drawing room or a conference room which accommodates a plurality of indoor units, and the block is each floor of a building, which floor includes a plurality of rooms.

A display screen for each group is configured to include an operation mode display field 71, an airflow rate symbol 72, an airflow-rate regulation display field 73, a temperature setting display field 74, an airflow direction display field 75. The airflow-rate regulation display field 73 includes a plurality of trapezoidal portions to display the airflow rate on the basis of the airflow rate setting information. This display on the airflow-rate regulation display field 73 allows the user to easily know the setting information on the airflow rate for each group. For example, FIG. 7 shows a case in which the number of the airflow rate taps for each group is four and the group 5 has the airflow rate set to three. FIG. 7 shows the display example in which all the indoor units are the same model, but, if any models have the different number of the taps from others, as a matter of course, the number of icons in the trapezoidal portion may be changed to be displayed.

Figure 8:
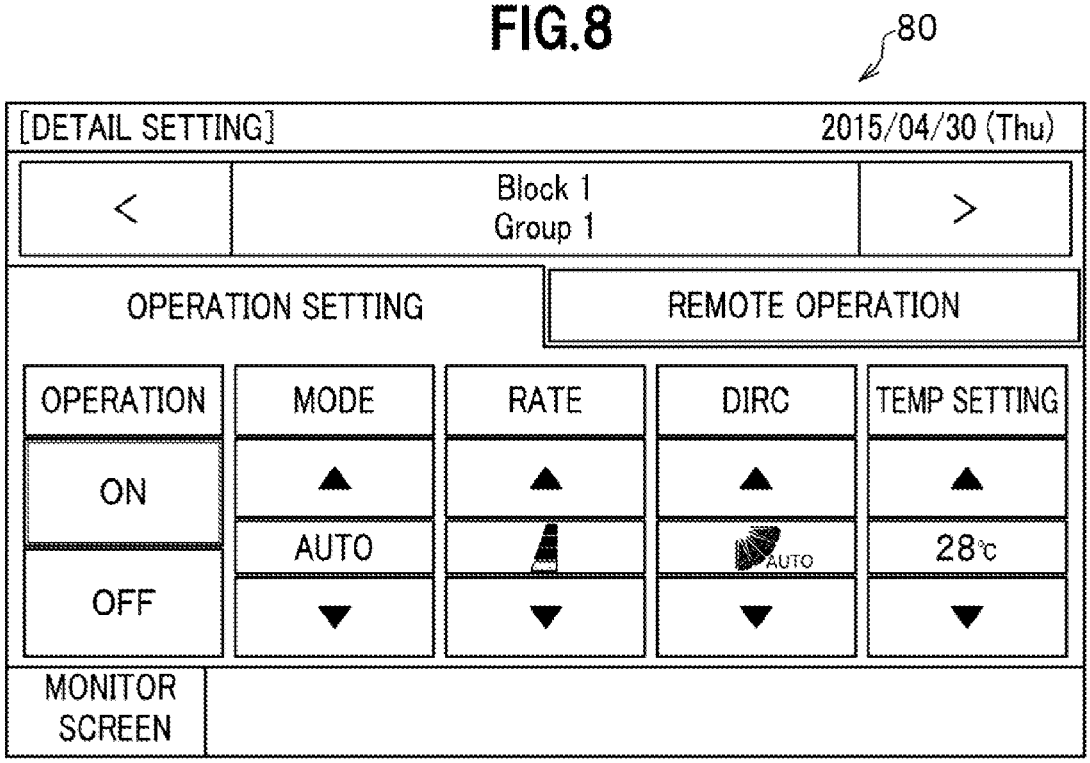
FIG. 8 is a diagram showing a setting screen example of the central control device.

When the display screen for one of the groups is pressed, the setting screen for the group selected appears (see FIG. 8).

FIG. 8 is a diagram showing a setting screen of the central control device 100A. An operation setting of the setting screen 80 allows each room to be set in an operation start and stop, an operation mode, an airflow rate, an airflow direction, a temperature setting. The operation mode, airflow rate, airflow direction, and temperature setting may be changed by pressing the top and bottom switches.

Figure 9:
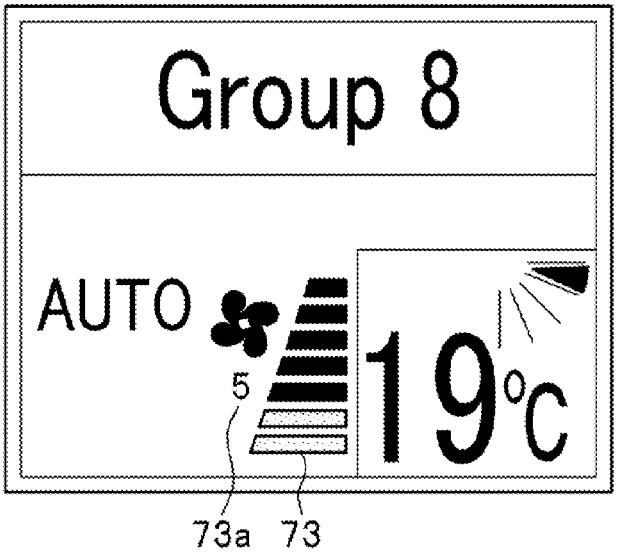
FIG. 9 is a diagram showing a case in which the number indicator is added to display the airflow rate setting.

FIG. 9 is a diagram showing a case in which the number indicator is added to display the airflow rate setting. FIG. 9 shows a modified example of the display screen for the groups shown in FIG. 7, that is, a case of adding a number 73*a* corresponding to a current airflow rate in the vicinity of the airflow-rate regulation display field 73 shown in FIG. 7. FIG. 9 shows a case that the number of the airflow rate taps is seven, the airflow rate setting is five, and the display of the number 73*a* corresponding to the airflow rate setting enables the current setting airflow rate to be shown specifically to a user.

According to this embodiment, the remote controller of the air-conditioner enables a user to grasp the status of the airflow rate of the air-conditioner by a glance at the icon for the airflow rate, and convenience for the user to be improved. That is, the user may simply and intuitively grasp the setting status of the airflow rate of the air-conditioner. Additionally, in each country with a different language from each other, the icon of the airflow rate would enable a user in each country to simply and intuitively grasp the setting status of the airflow rate of the air-conditioner.

The present invention is described here using several embodiments in order to describe the solution to the problems for the present patent application, but is not limited thereto. Within a range without any inconsistency, any modifications may be implemented, for example, a combination of the embodiments or a combination of several features of the embodiments.

REFERENCE SIGNS LIST

10: processing unit
11: air-conditioner information collection unit
12: air-conditioner status monitoring unit
13: screen generation unit
14: air-conditioner control unit
20: storage unit
21: air-conditioner information
30: communication unit
40: input unit
41: operation start/stop switch
42: cross switch
43: decision switch
44: menu switch
45: back/guide switch
46: power-saving switch
50: display unit
51: operation mode display field
52: airflow-rate regulation display field
53: airflow direction display field
54: temperature setting display field
60: output unit
100: air-conditioning remote controller (remote controller)
100A: central control device
200: indoor unit
300: outdoor unit
520: area (airflow-rate icon area)
521, 522, 523, and 524: trapezoidal portion

We claim:

1. An air-conditioning remote controller capable of controlling a plurality of models of air-conditioners, comprising:

an input unit via which a setting value for one or more setting items to control operation of an air-conditioner is inputted; and a display unit including a predefined area in which a plurality of icons are displayed to visually represent the setting value for a corresponding setting item, where a number of the plurality of icons displayed is determined based on the inputted setting value and a total number of taps for the corresponding setting item for a model of a main body of the air-conditioner, wherein the display unit sets a maximum displayable number of the icons to be equal to or higher than the total number of taps for the corresponding setting item for the model of the main body of the air-conditioner to be controlled using the setting value.

2. The air-conditioning remote controller according to claim 1, wherein as the maximum displayable number of the icons decreases, an area of each icon displayed in the predefined area becomes larger.

3. The air-conditioning remote controller according to claim 1, wherein the total number of taps is a number of airflow rate taps indicating an airflow rate of the air-conditioner, and the air-conditioning remote controller further comprises:

a storage unit configured to store initial setting information including the number of the airflow rate taps; and a processing unit configured to display, on the display unit, setting information of the airflow rate inputted via the input unit, by vertically dividing the predefined area into sub-areas by the number of the airflow rate taps, and displaying the setting information of the airflow rate using a trapezoid displayed in each of the sub-areas, where the trapezoid has a pair of mutually parallel opposite sides at the top and bottom, and each of the trapezoids has an area larger than an area of a trapezoid vertically immediately above.

4. The air-conditioning remote controller according to claim 3, wherein the processing unit is configured to display the trapezoids on the display unit, by displaying a same number of the trapezoids as the number of the airflow rate taps in a first color; and displaying the setting information of the airflow rate in a second color different from the first color.

5. The air-conditioning remote controller according to claim 3, wherein the processing unit is configured to display the trapezoids on the display unit, while displaying a numeral indicating the setting information of the airflow rate in a vicinity of the trapezoids.

6. The air-conditioning remote controller according to claim 3, wherein each of the trapezoids displayed on the display unit has one pair of opposite sides in the left-right direction and at least one side of the one pair of the opposite sides of each of the trapezoids is aligned on a straight line.

7. The air-conditioning remote controller according to claim 3, wherein the processing unit is configured to collect air-conditioner information including the number of the airflow rate taps from the main body of the air-conditioner via a communication unit and to store the air-conditioner information in the storage unit.

8. An air-conditioning remote controller capable of controlling a plurality models of air-conditioners, comprising:

a display unit configured to display setting information for a main body of an air-conditioner;

a storage unit configured to store initial setting information including a number of airflow rate taps being displayable on the display unit;

an input unit configured to receive an input; and a processing unit configured to display setting information of the airflow rate inputted via the input unit on the display unit, by vertically dividing a predefined area into sub-areas by the number of the airflow rate taps, and displaying the setting information of the airflow rate using a trapezoid displayed in each of the sub-areas, where the trapezoid has a pair of mutually parallel opposite sides at the top and bottom, and each of the trapezoids has an area larger than an area of a trapezoid vertically immediately above, wherein the display unit sets a maximum displayable number of the trapezoids in the predefined area to be equal to or higher than the stored number of airflow rate taps.

9. An air conditioning system comprising:

the air-conditioning remote controller and the main body of the air-conditioner, according to claim 1.

10. An air conditioning system comprising:

the air-conditioning remote controller and the main body of the air-conditioner, according to claim 2.

11. An air conditioning system comprising:

the air-conditioning remote controller and the main body of the air-conditioner, according to claim 3.

12. An air conditioning system comprising:

the air-conditioning remote controller and the main body of the air-conditioner, according to claim 4.

13. An air conditioning system comprising:

the air-conditioning remote controller and the main body of the air-conditioner, according to claim 5.

14. An air conditioning system comprising:

the air-conditioning remote controller and the main body of the air-conditioner, according to claim 6.

15. An air conditioning system comprising:

the air-conditioning remote controller and the main body of the air-conditioner, according to claim 7.

16. An air conditioning system comprising:

the air-conditioning remote controller and the main body of the air-conditioner, according to claim 8.

* * * * *